US008132892B2

(12) United States Patent
Nystrom et al.

(10) Patent No.: US 8,132,892 B2
(45) Date of Patent: Mar. 13, 2012

(54) MAINTAINABLE COPLANAR FRONT FACE FOR SILICON DIE ARRAY PRINTHEAD

(75) Inventors: Peter J. Nystrom, Webster, NY (US); Peter M. Gulvin, Webster, NY (US); John P. Meyers, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 433 days.

(21) Appl. No.: 12/536,196

(22) Filed: Aug. 5, 2009

(65) Prior Publication Data

US 2009/0289994 A1 Nov. 26, 2009

Related U.S. Application Data

(62) Division of application No. 11/837,728, filed on Aug. 13, 2007, now Pat. No. 7,591,535.

(51) Int. Cl.
*B41J 2/155* (2006.01)

(52) U.S. Cl. ..... 347/42; 347/49

(58) Field of Classification Search ..... 347/13, 347/42, 49
See application file for complete search history.

(56) References Cited

U.S. PATENT DOCUMENTS

| | | | | |
|---|---|---|---|---|
| 5,432,539 | A | 7/1995 | Anderson | |
| 5,528,272 | A | 6/1996 | Quinn et al. | |
| 5,801,727 | A | 9/1998 | Torpey | |
| 6,165,813 | A | 12/2000 | Quinn et al. | |
| 6,409,307 | B1 * | 6/2002 | Akhavain et al. | 347/42 |
| 6,692,101 | B2 | 2/2004 | Lodal et al. | |

* cited by examiner

*Primary Examiner* — Lamson Nguyen
(74) *Attorney, Agent, or Firm* — MH2 Technology Law Group LLP

(57) ABSTRACT

A full width array printhead is provided having a continuous maintainable printhead surface and method of forming the same. The printhead includes a substrate and an array of die modules mounted thereon with a front face of each die module exposed. A hardened fill material surrounds the array of die modules to define a continuous surface coplanar with the front face of the array of die modules.

11 Claims, 3 Drawing Sheets

MAINTAINABLE COPLANAR FRONT FACE FOR SILICON DIE ARRAY PRINTHEAD

CROSS REFERENCE TO RELATED APPLICATION

This application is a divisional application of U.S. patent application Ser. No. 11/837,728 filed on Aug. 13, 2007, the disclosure of which is incorporated herein by reference in its entirety.

FIELD OF THE INVENTION

The present invention generally relates to an ink jet printhead, and more particularly, a coplanar surface of a silicon die array printhead.

BACKGROUND OF THE INVENTION

In the fabrication of ink jet devices, printhead arrays can be used to increase print speed.

A typical printhead array can include a plurality of subunits known as a die module or chip. Each die module can comprise hundreds or thousands of fluid emitters. An exemplary full-width thermal fluid jet fluid ejecting head has one or more die modules forming a full-width array extending across the fill width of the receiving medium on which the image is to be printed. In these fluid ejecting heads with multiple die modules, each die module includes its own ink supply manifold, or multiple die modules can share a common ink supply manifold.

It is known that high quality nozzles can be formed in a silicon die module, making silicon a preferred material for this purpose. However, when the separate die modules are cut from a single silicon slab, each die module can be very sharp at the cut edges. This problem is compounded by the spacing of the individual modules in an array on a printhead unit because of the need to maintain the nozzles during use. Wiping across sharp cut edges of the individual die modules within an array can damage the wiper blades. Accordingly, current designs for die module arrays are limited in order to avoid having a wiper structure traverse the sharp edges of the die modules within the array or alone.

Current solutions to the problem include the provision of a monolithic front face to the printhead, systems of intermediate partial width arrays, adding a one-piece front face cap, and complex maintenance systems. However, all of these proposed solutions either negate the effectiveness of the silicon nozzles or add excessive cost to the final device.

Thus, there is a need to overcome these and other problems of the prior art and to provide a method for forming an ink jet printhead subassembly and the resulting device, each of which provides a smooth and uniform silicon die array printhead surface for ease of maintenance. The smooth, coplanar printhead surface is maintainable without causing damage to known printhead wipers or other maintenance techniques.

SUMMARY OF THE INVENTION

In accordance with the present teachings, a method of forming a subassembly for a full width array printhead is provided.

The exemplary method can include providing a substrate, mounting an array of die modules on a surface of the substrate with an active face of each die module exposed, and supplying a curable fill material laterally contiguous with the array of die modules to define a continuous printhead surface coplanar with the active face of the array of die modules.

In accordance with the present teachings, a subassembly for a full width array printhead is provided.

The exemplary subassembly can include a substrate; an array of die modules formed on a surface of the substrate, each die module comprising an active fluid emitting surface; and a fill material surrounding the array of die modules and coplanar with the active surfaces.

In accordance with the present teachings a printhead subassembly for an ink jet printer is provided.

The exemplary subassembly can include at least one silicon die module laterally contiguous with a cured molding material, the silicon die module and cured molding material defining a continuous exposed surface.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention

DESCRIPTION OF THE EMBODIMENTS

Reference will now be made in detail to the exemplary embodiments of the invention, examples of which are illustrated in the accompanying drawings. However, one of ordinary skill in the art would readily recognize that the same principles are equally applicable to, and can be implemented in devices other than ink jet printers, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

Embodiments pertain generally to ink jet printheads, and more particularly to the die module array subassembly thereof. Although the embodiments are described in connection with structures for "fluid", it will be appreciated that the fluid can be ink, biologic fluid, industrial fluid, or chemical fluid, by way of non-limiting examples.

A silicon member having a plurality of ink channels is known as a "die module" or "chip". Each die module can comprise hundreds, thousands, or more of the fluid emitters, spaced 100, 180, 200 or 300 or more to the inch. An exemplary full-width thermal fluid jet fluid ejecting head has one or more die modules forming a full-width array extending across the full width of the receiving medium on which the image is to be printed. In fluid ejecting heads with multiple die modules, each die module can includes its own ink supply manifold, or multiple die modules can share a common ink supply manifold.

Figure 1:
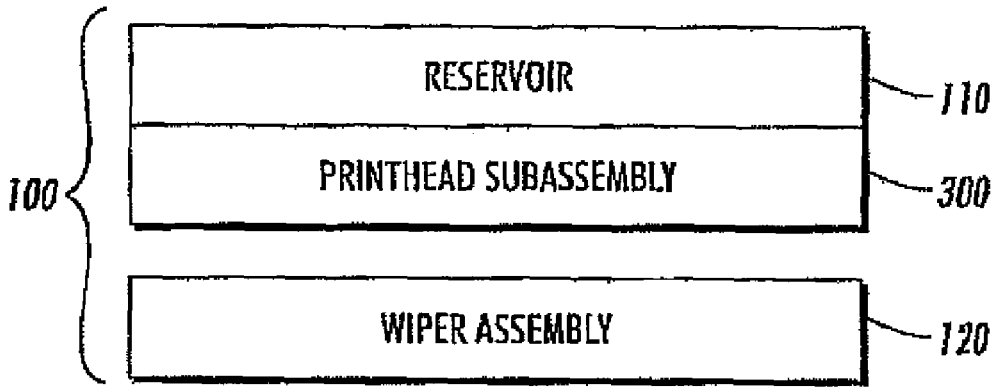
FIG. 1 depicts a perspective view of an exemplary ink jet printhead incorporating a completed subassembly in accordance with embodiments of the present teachings.

FIG. 1 illustrates a full width array type printhead 100 according to an exemplary embodiment herein. A full width array printhead will be understood herein to include an array of ejectors and extends the full width of a print sheet. Such a printhead can also encompass a large partial width array printhead. The printhead 100 can include the subassembly 300 of FIG. 3, an ink supply 110 connected to the subassembly, and a wiper assembly 120 opposing an active surface of the subassembly 300.

Passageways (not shown) can be provided to connect the ink supply 110, such as a reservoir, to nozzle outlets (not shown) in the active fluid emitting surface of die modules in the printhead. The fluid emitting surface is known in the art to include a plurality of nozzle openings, which are omitted from the figures herein for purposes of simplification. Numbers and patterns of nozzle openings can vary widely and their detail does not form a part of the invention.

The wiper assembly 120 can be used to clear debris from the active fluid emitting surface of the subassembly 300. The wiper assembly 120 can include flexible rubber or polymer blades, and the specific structure thereof can vary according to design parameters.

Figure 2:
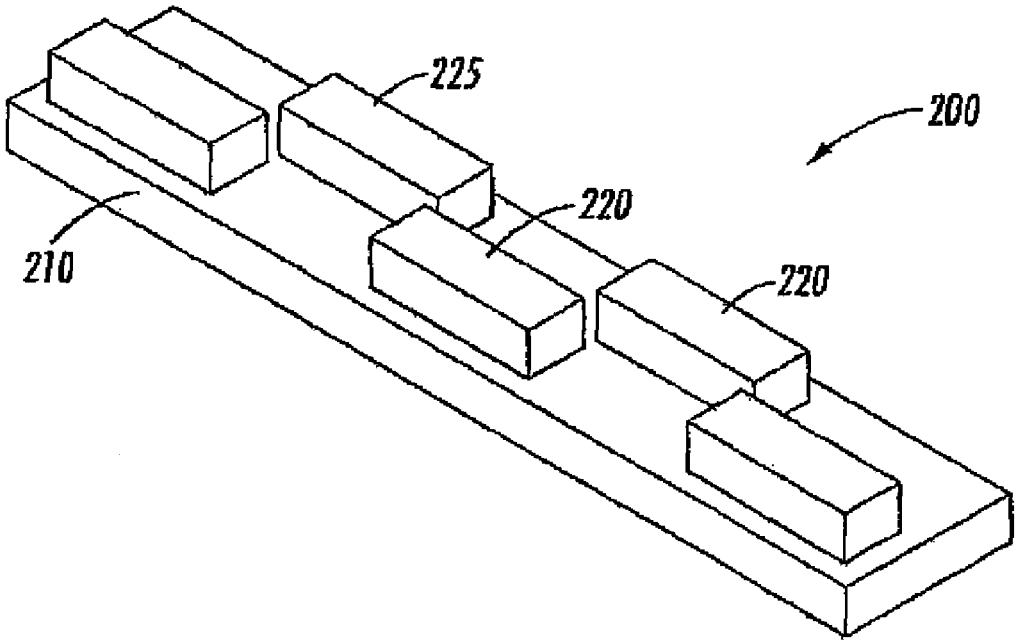
FIG. 2 is a perspective view of a die module subassembly of a printhead subassembly in accordance with embodiments of the present teachings.

As depicted in FIG. 2, a die module subassembly 200 can include a substrate 210 and an array of die modules 220 mounted on the substrate 210. Each of the die modules 220 can include a mounting surface (not shown) and the fluid emitting or "active" surface 225. The mounting surface is that which is fixed to the substrate 210, while the active surface 225 includes the fluid dispensing surface. Mounting of the individual die modules 220 within the array can be by any known means including, but not limited to, adhesive, welding, encapsulation, and the like. In addition, while the array pattern is depicted as staggered, any suitable pattern can be used, including overlapping of the individual modules as is known in the art. It will be appreciated, as described above, that the active surface 225 can include a plurality of nozzle outlets formed in various shapes and patterns therein.

The substrate 210 can be a simple circuit board material such as a high Tg FR4 ranging up to a Low Temperature Co-fired Ceramic (LTCC) substrate.

Figure 3:
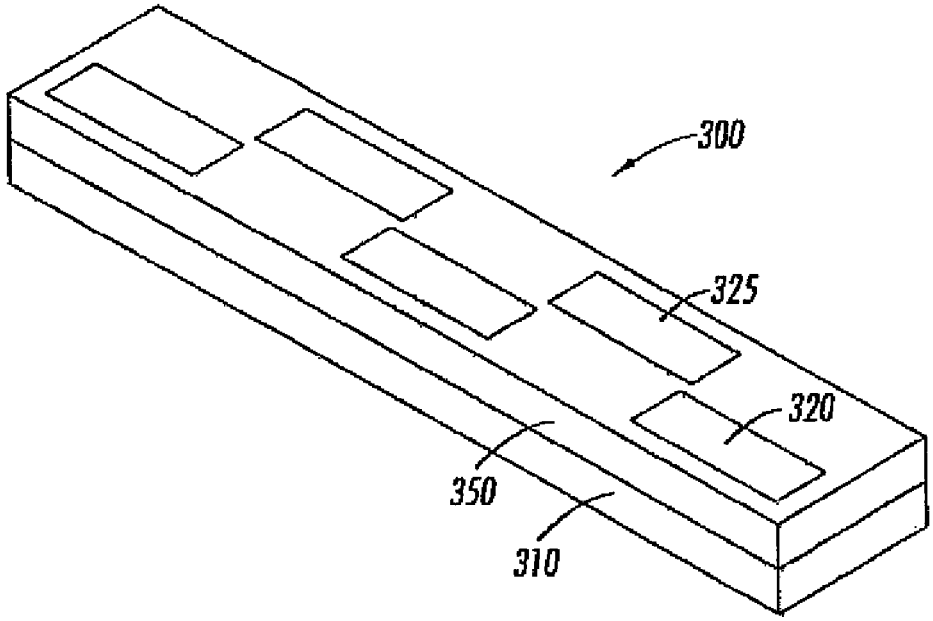
FIG. 3 is a perspective view of a printhead subassembly at a further stage of assembly with respect to FIG. 2 and in accordance with embodiments of the present teachings.

Referring now to FIG. 3, printhead subassembly 300 can include a hardenable material 350 supplied to surround the plurality of die modules 320 mounted on the substrate 310. The hardenable material 350 can be supplied to a height coplanar with the active surface 325 of the array of die modules 320.

As depicted, the hardenable material 350 can initially be of a sufficient fluidity to create a seamless and coplanar upper surface with the die modules 320. Such a smooth planar upper surface of the subassembly 300 is free of sharp edges which could otherwise affect maintenance of the surface, particularly maintenance with wiper assemblies. An example of the type of wiper assembly suitable for use in the present invention is that described in U.S. Pat. No. 5,432,539, incorporated herein by reference in its entirety.

While a hardenable material 350 is described, it will be appreciated that the hardenable material can include a curable material suitable for the exemplary purpose.

Figure 4:
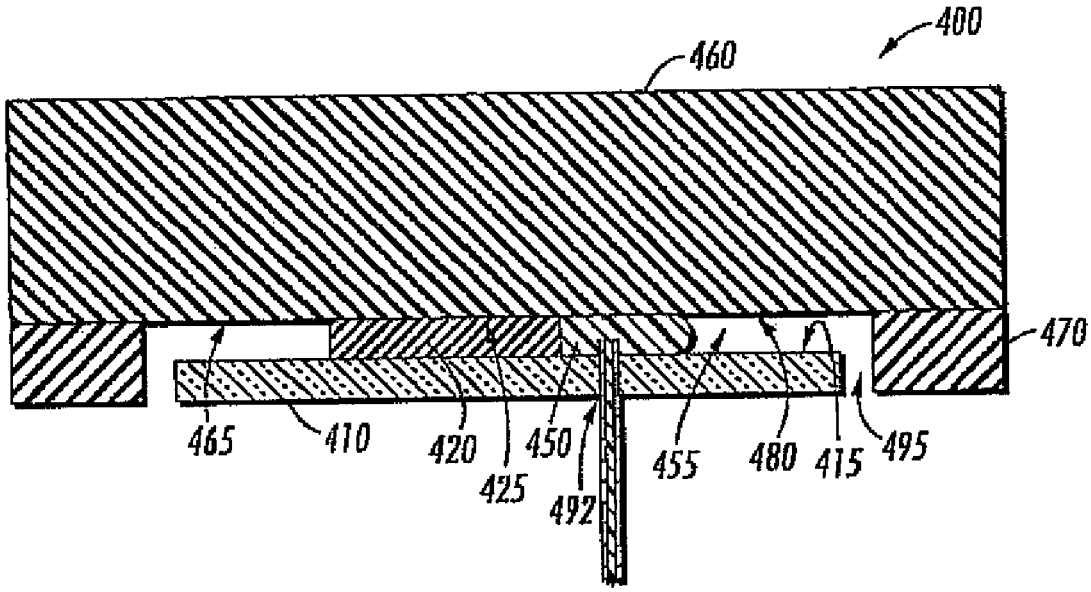
FIG. 4 is a side view illustrating an exemplary molding fixture in accordance with embodiments of the present teachings.

FIG. 4. is a schematic cross sectional view of a portion of an exemplary device 400 for supplying the curable material 450 to form the printhead subassembly 300 of FIG. 3. In particular, the exemplary device can include a molding component 460 shaped to include an engaging surface 465 and depending legs 470 surrounding the substrate 410. The die module engaging surface 465 can be planar in order to avoid gaps between the active surface 425 of the die module 420 and the engaging surface 465 of the molding component 460.

In addition, a sealing layer 480 can be positioned between the active surface 425 of the die module 420 and the engaging surface 465 of the molding component 460. The sealing layer 480 can be a material initially applied to the active surface 425 of the die module 420 or to the engaging surface 465 of the molding component 460, or both.

An injection member 490, such as an injection needle, can pass through one or more ports 492 of the substrate 410. The injection member 490 can be positioned to inject molding material 450 under pressure into a cavity 455 or interstices defined by the remaining space surrounding the die modules 420 and between the planar engaging surface 465 and the planar upper surface 415 of the substrate 410. Excess molding material 450 can be evacuated from the interstices 455 by suitable exhaust ports 495. In addition, other excess material can be trimmed away after the molding process.

It will be appreciated that while the molding device 400 is illustrated in an exemplary embodiment for providing the molding material 450 as described, it is understood that a suitable molding material could be found which does not require used of the molding component. In either instance the result can be a uniform, smooth surface that is easy to maintain in a printer environment.

Figure 5:
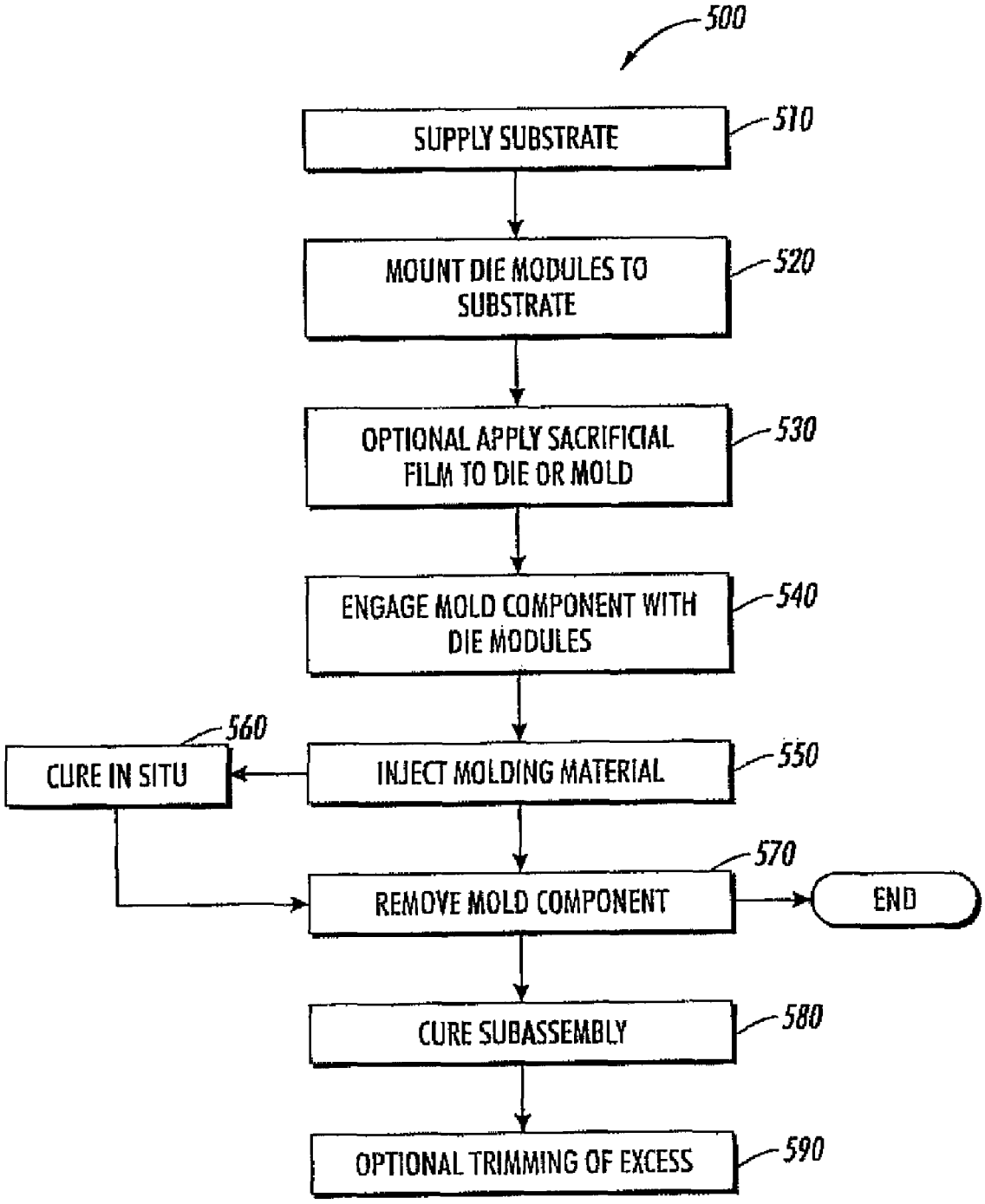
FIG. 5 is a flow chart depicting a method in accordance with exemplary embodiments of the present teachings.

A method 500 for forming the subassembly 300 of FIG. 3 and using the device of FIG. 4 can include those steps described in FIG. 5. It will be appreciated that while certain steps are shown, other steps may be added or existing steps can be removed or modified without departing from the scope of the invention.

Continuing, forming of the subassembly 300 can include supplying a substrate 310 at (step 510). A plurality of die modules 320 can be mounted to the substrate 310 at step 520. The die modules 320 can be positioned or staggered in an array suitable for any full width printing array.

An optional step 530 can be included for applying a sacrificial film 480 to one or both of the die modules 420 and the engaging surface 465 of the molding component 460. Use of the sacrificial film 480 can enhance protection of the parts during molding and final processing.

At 540, the molding component 460 is positioned such that the engaging surface 465 thereof is in continuous surface contact with the active surfaces 425 of all of the module components 420. At step 550, the curable molding material 450 is injected into the open regions 455 surrounding the die modules 420 and between the planar upper surface 415 of the substrate 410 and planar engaging surface 465 of the molding component 460.

At 560, the molding material 450 can be cured in situ prior to removal of the molding component 460 from the subassembly at 570. As an alternative, the molding material can be cured at 580 subsequent to removal of the molding component from the subassembly at 570. In addition, it is appreciated that certain materials can be partially cured at 560 prior to removal of the molding component 460 after which a final cure can take place at 580. If the subassembly is removed from the molding component 460 for curing, it can be cured in batches along with similar subassemblies.

Subsequent to a curing, any excess molding material 450 can be trimmed from the subassembly at step 590 as desired.

The molding material 450 can be an encapsulant, such as an underfill encapsulant. In addition, a variety of known molding materials suitable for use in the exemplary embodiments include those which are epoxy based and rapidly cured to enable efficient duration of manufacturing cycles. Compound formulations can vary and are driven by enormous worldwide volume and are responsive to environmental concerns. In any event, the molding material can be selected to complement the coefficient of thermal expansion (CTE) of the substrate used. The molding material used can be of a composition, such as glass filled epoxies, which will not shrink or separate from the silicon material of the die modules, and have a similar CTE as the die modules. Non-limiting examples include those materials available in the 3-20 ppm/degree C. range, which are also compatible with substrate and wirebond materials. This value can be adjusted by altering the filler silica content as known in the art.

As an exemplary alternative, the molding material can be a low viscosity material. The low viscosity material can be poured or otherwise supplied to the molding component 460 such that the molding material flows to surround into the desired fill volume. Subsequent curing of the low viscosity molding material will render a suitable hardness to the fill material and provide the same results as injection molded material.

Although the relationships of components are described in general terms, it will be appreciated by one of skill in the art can add, remove, or modify certain components without departing from the scope of the exemplary embodiments.

It will be appreciated by those of skill in the art that several benefits are achieved by the exemplary embodiments described herein and include the use of low cost materials such as polymer molding compounds that are resistant to a wide variety of chemicals and ink. The compounds selected can be used in a high temperature environment, typically up to about 125° C. The method and structure still allow for the formation of integrated fluid and electrical interconnects. Further, the subassembly can be marked with indelible (such as by laser) part numbers and date codes for identification purposes.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a difference order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A full width array printhead comprising:

a substrate;

an array of die modules formed on a surface of the substrate, each die module comprising an active fluid emitting surface; and a fill material surrounding the array of die modules and coplanar with the active surfaces.

2. The printhead of claim 1, wherein the fill material is a curable molding compound.

3. The printhead of claim 1, wherein the coplanar upper active surfaces and fill material interact with a wiper without catching the wiper on edges of individual die within the array.

4. The printhead of claim 1, further comprising a mold component having a planar surface engageable with the active faces of the die modules and forming a fill region defined by non-die areas between the engaged mold component and the substrate, the fill material encompassing the fill region.

5. The printhead of claim 4, wherein the fill material is cured prior to removing the mold component.

6. The printhead of claim 4, wherein the fill material is cured subsequent to removing the mold component.

7. The printhead of claim 4, wherein the fill material is supplied from a substrate side of the array.

8. The printhead of claim 4, further comprising a sacrificial film between the die module array and the mold component.

9. The printhead of claim 1, wherein the fill material is selected to complement a coefficient of thermal expansion of the substrate.

10. A printhead for an ink jet printer, the printhead comprising:

at least one silicon die module laterally contiguous with a cured molding material, the silicon die module and cured molding material defining a continuous upper surface.

11. The printhead of claim 10, further comprising an array of silicon die modules.

* * * * *